US012458856B1

(12) United States Patent
Michelsen

(10) Patent No.: US 12,458,856 B1
(45) Date of Patent: Nov. 4, 2025

(54) AERODYNAMICALLY CONFIGURABLE HORSESHOE PROJECTILE DEVICES

(71) Applicant: Jeff A. Michelsen, Glendora, CA (US)

(72) Inventor: Jeff A. Michelsen, Glendora, CA (US)

( * ) Notice: Subject to any disclaimer, the term of this patent is extended or adjusted under 35 U.S.C. 154(b) by 47 days.

(21) Appl. No.: 18/653,036

(22) Filed: May 2, 2024

(51) Int. Cl.
*A63B 67/06* (2006.01)
*A63B 65/00* (2006.01)

(52) U.S. Cl.
CPC ..... *A63B 67/06* (2013.01); *A63B 65/00* (2013.01); *A63B 2067/063* (2013.01); *A63B 2225/01* (2013.01); *A63B 2225/09* (2013.01)

(58) Field of Classification Search
CPC ... A63B 67/06; A63B 65/00; A63B 2067/063; A63B 2225/01; A63B 2225/09
See application file for complete search history.

(56) References Cited

U.S. PATENT DOCUMENTS 2,477,531 A * 7/1949 Volman ..... F42B 6/003 473/570
3,602,509 A * 8/1971 Curtiss ..... A63B 67/06 273/339
RE28,467 E * 7/1975 Curtiss ..... A63F 9/0208 273/339
4,265,454 A * 5/1981 Bayless ..... A63B 67/06 473/591
4,880,242 A * 11/1989 White ..... A63B 67/06 473/591
5,317,489 A * 5/1994 Delli Gatti ..... F21V 33/008 446/485
5,704,857 A * 1/1998 Davenport ..... A63B 67/06 D21/387
6,220,918 B1 * 4/2001 Laronge ..... A63B 65/00 473/585
7,775,920 B1 * 8/2010 Kuchcinski ..... A63B 67/06 473/591
7,874,947 B1 * 1/2011 Wolfinbarger ..... A63H 33/18 473/578
8,348,789 B1 * 1/2013 Walterscheid ..... F42B 6/003 473/578
9,091,514 B1 * 7/2015 Cummings ..... F42B 12/382
9,310,171 B2 * 4/2016 Cummings ..... A63H 27/14
10,391,374 B1 * 8/2019 Toronto ..... A63B 43/002
11,441,868 B2 * 9/2022 Martino ..... A63B 43/002
2008/0179834 A1 7/2008 Fang
2016/0263456 A1 * 9/2016 Roberts ..... A63B 67/06
2024/0165474 A1 * 5/2024 Bazzoni ..... A63B 67/06

* cited by examiner

*Primary Examiner* — Steven B Wong
(74) *Attorney, Agent, or Firm* — UCLA Patent Law Clinic

(57) ABSTRACT

Aerodynamically configurable horseshoe projectile devices in accordance with embodiments of the invention are disclosed. In one embodiment, a horseshoe projectile device having configurable aerodynamics is provided, the horseshoe projectile device comprising: a horseshoe comprising an open end and a closed end, wherein the closed end comprises a mounting point for receiving a shaft; the shaft comprising a first end, a second end, and a body, wherein the first end of the shaft connects to the mounting point of the horseshoe; and a tail fin comprising a bore that receives the body of the shaft and having a plurality of wings extending outward from the bore.

20 Claims, 10 Drawing Sheets

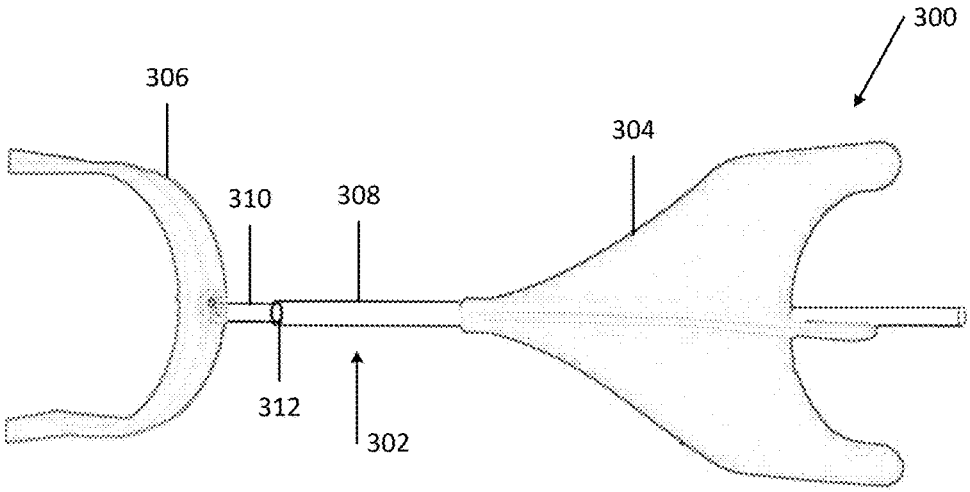
FIG. 3A
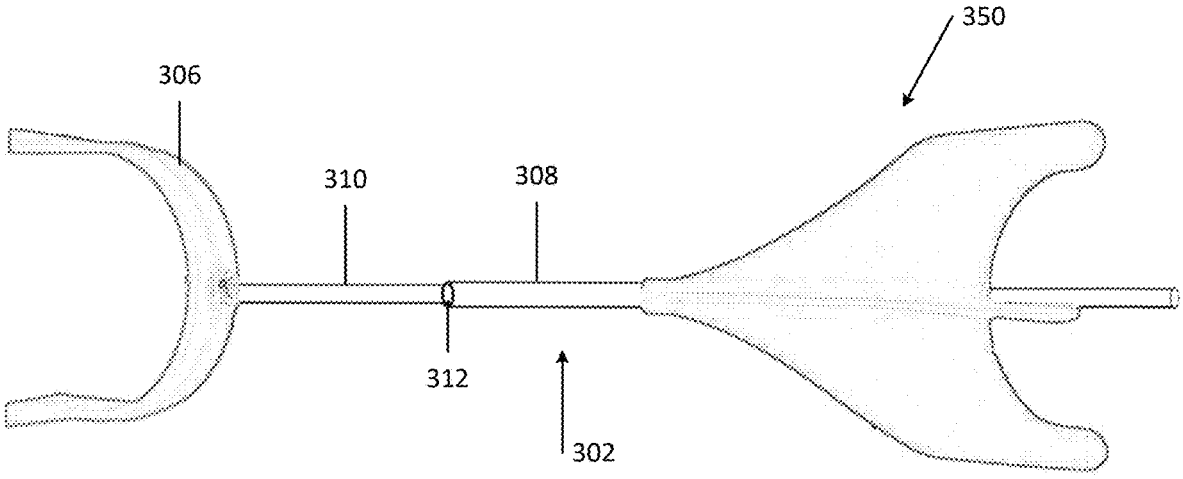
FIG. 3B
FIG. 3

AERODYNAMICALLY CONFIGURABLE HORSESHOE PROJECTILE DEVICES

FIELD OF THE INVENTION

The present invention generally relates to games and more specifically to aerodynamically configurable horseshoe projectile devices.

BACKGROUND

The game of horseshoes is a classic lawn game in which players throw U-shaped projectiles toward stakes planted in the ground. Points are awarded based on accuracy. The goal is to hook the projectile onto the stake, or to come as close as possible to doing so. The game of horseshoes can be played as a one-on-one competition or in teams.

SUMMARY OF THE INVENTION

The various embodiments of the present horseshoe projectile devices contain several features, no single one of which is solely responsible for their desirable attributes. Without limiting the scope of the present embodiments, their more prominent features will now be discussed below. In particular, the present horseshoe projectile devices will be discussed in the context of configurable aerodynamics. However, the use of particular aerodynamically configurable horseshoe projectile devices is merely exemplary and various other horseshoe projectile devices may be utilized for configurable aerodynamics as appropriate to the requirements of a specific application in accordance with various embodiments of the invention. After considering this discussion, and particularly after reading the section entitled "Detailed Description," one will understand how the features of the present embodiments provide the advantages described here.

One aspect of the present embodiments includes the realization that in current horseshoe devices other than the present embodiments, there is a lack of aerodynamic configurability, which makes the game un-customizable for players. For example, horseshoe devices do not have wings or extendable shafts to make the horseshoe projectiles customizable for smaller children to play. The present embodiments solve this problem by allowing individuals players to change the length of the shaft, the ability for the horseshoe to rotate, and the ability for the tail fin to rotate and slide along the shaft to customize the horseshoe projectile device to fit the needs of each player. The present embodiments thus advantageously enable these customizable features. The present embodiments provide these advantages and enhancements, as described below.

In a first aspect, a horseshoe projectile device having configurable aerodynamics is provided, the horseshoe projectile device comprising: a horseshoe comprising an open end and a closed end, wherein the closed end comprises a mounting point for receiving a shaft; the shaft comprising a first end, a second end, and a body, wherein the first end of the shaft connects to the mounting point of the horseshoe; and a tail fin comprising a bore that receives the body of the shaft and having a plurality of wings extending outward from the bore.

In an embodiment of the first aspect, the horseshoe and the shaft are attached at the mounting point of the horseshoe such that the horseshoe can rotate relative to the shaft.

In another embodiment of the first aspect, the horseshoe and the shaft are attached at the mounting point of the horseshoe such that the horseshoe cannot rotate relative to the shaft In another embodiment of the first aspect, the horseshoe and the shaft are attached at the mounting point by a lockable horseshoe connection having a first configuration that prevents the horseshoe from rotating relative to the shaft and a second configuration that allows the horseshoe to rotate relative to the shaft.

In another embodiment of the first aspect, the lockable horseshoe connection comprises a first horseshoe lock and a second horseshoe lock.

In another embodiment of the first aspect, the shaft is extendable.

In another embodiment of the first aspect, the shaft comprises: a first slidable rod having a first end, a second end, an inner surface, an outer surface, and a thickness, wherein the first slidable rod is hollow; and wherein the thickness is the distance between the inner surface and the outer surface; a second slidable rod having a first end, a second end, and an outer surface, wherein the first end of the second slidable rod is nested within the second end of the first slidable rod.

In another embodiment of the first aspect, the shaft comprises a slidable rod lock, and wherein the slidable rod lock fixes a depth to which the second slidable rod is nested within the first slidable rod, and wherein the depth to which the second slidable rod is nested within the first slidable rod controls the length of the shaft.

In another embodiment of the first aspect, the slidable rod lock comprises: a depressible raised button on the second slidable rod having a locked position and an unlocked position wherein the locked position is convex relative to the outer surface of the second slidable rod, and wherein the locked position has a height greater than the thickness of the first rod; a plurality of holes on the first slidable rod wherein each hole of the plurality of holes is configured to receive the depressible raised button on the second slidable rod such that the depressible raised button locks the relative positions of the first slidable rod and second slidable rod.

In another embodiment of the first aspect, the bore of the tail fin receives the body of the shaft such that the tail fin can rotate relative to the shaft.

In another embodiment of the first aspect, the bore of the tail fin receives the body of the shaft such that the tail fin cannot rotate relative to the shaft.

In another embodiment of the first aspect, the horseshoe projectile device comprises a tail fin fixture having a first configuration that prevents the tail fin from rotating relative to the shaft and a second configuration that allows the tail fin to rotate relative to the shaft In another embodiment of the first aspect, the position of the tail fin along the body of the shaft is fixed.

In another embodiment of the first aspect, the position of the tail fin along the body of the shaft is movable.

In another embodiment of the first aspect, the position of the tail fin along the body of the shaft is adjustable and wherein a tail fin fixture fixes the position of the tail fin along the body of the shaft at a desired position.

In another embodiment of the first aspect, the tail fin fixture comprises a first tail fin lock and a second tail fin lock.

In another embodiment of the first aspect, the position of the tail fin along the body of the shaft is fixed.

In another embodiment of the first aspect, the position of the tail fin along the body of the shaft is movable.

In another embodiment of the first aspect, the position of the tail fin along the body of the shaft is adjustable and wherein a tail fin fixture fixes the position of the tail fin along the body of the shaft at a desired position.

In another embodiment of the first aspect, the tail fin fixture comprises a first tail fin lock and a second tail fin lock.

BRIEF DESCRIPTION OF THE DRAWINGS

The various embodiments of the present aerodynamically configurable horseshoe projectile devices (may also be referred to as "horseshoe projectile devices") now will be discussed in detail with an emphasis on highlighting the advantageous features. These embodiments depict the novel and non-obvious horseshoe projectile devices shown in the accompanying drawings, which are for illustrative purposes only. These drawings include the following figures:

FIG. 3A illustrates a horseshoe projectile device with a shaft in a shortened configuration in accordance with certain embodiments of the invention.

FIG. 3B illustrates a horseshoe projectile device with a shaft in a lengthened configuration in accordance with certain embodiments of the invention.

DETAILED DESCRIPTION OF THE DRAWINGS

Figure 1:
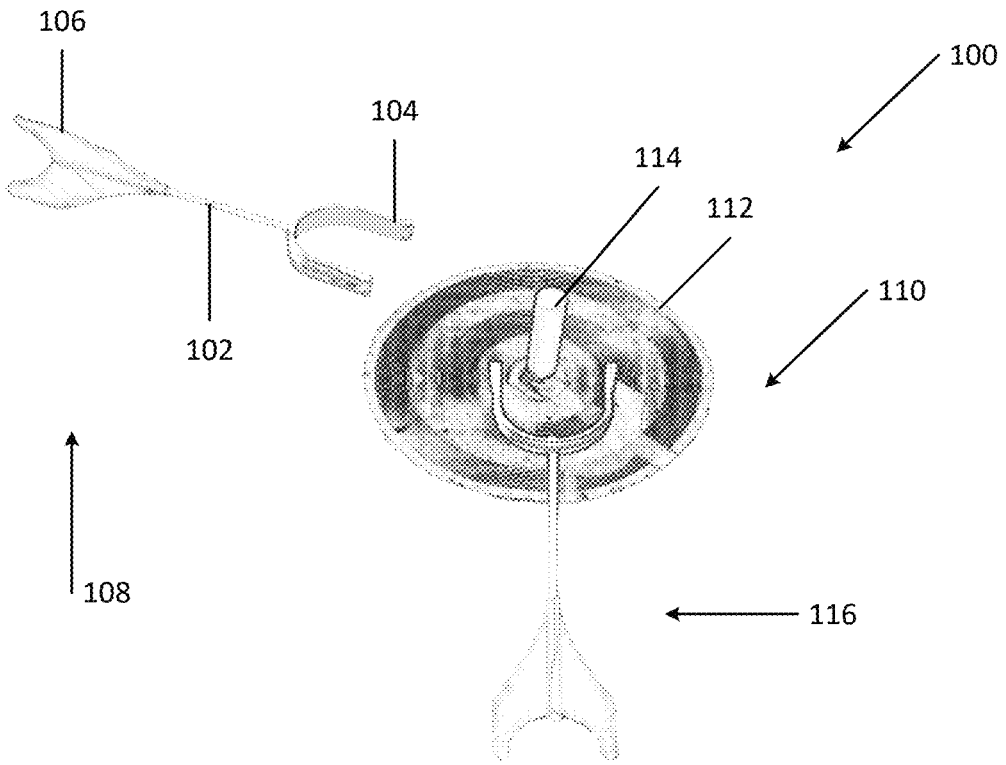
FIG. 1 illustrates a game utilizing horseshoe projectile devices in accordance with certain embodiments of the invention.

The following detailed description describes the present embodiments with reference to the drawings. In the drawings, reference numbers label elements of the present embodiments. These reference numbers are reproduced below in connection with the discussion of the corresponding drawing features.

Turning now to the drawings, aerodynamically configurable horseshoe projectile devices in accordance with embodiments of the invention are illustrated. In many embodiments, horseshoe projectile devices may include a horseshoe having an open end and a closed end. In some embodiments, the closed end may include a mounting point for receiving a shaft. In some embodiments, the horseshoe and the shaft may be attached such that the horseshoe can rotate relative to the shaft, as further described below. In some embodiments, the horseshoe and the shaft may be attached at the mounting point utilizing a lockable horseshoe connection that prevents the horseshoe from rotating relative to the shaft. In many embodiments, the shaft may include a first end and a second end, where the second end of the shaft may connect to the mounting point of the horseshoe. In several embodiments, the horseshoe projectile device may include a tail fin having wings and a bore that receives the shaft, as further described below.

In various embodiments, the horseshoe projectile device may have configurable aerodynamics by allowing a user to configure various components of the horseshoe projective device. For example, the user may configure the shaft to various lengths (e.g., a shortened configuration and/or a lengthened configuration) thereby allowing the user to configure the aerodynamics. In another example, the user may rotate the tail fin relative to the shaft further allowing the user to configure the aerodynamics. As further described below, various components of the horseshoe projective device may be adjusted allowing for configurable aerodynamics. For example, in some embodiments, the bore of the tail fin may receive the shaft such that the tail fin cannot rotate relative to the shaft. In other embodiments, the bore of the tail fin may receive the shaft such that the tail fin can rotate relative to the shaft. In some embodiments, the position of the tail fin along the body of the shaft may move relative to the shaft. In some embodiments, the position of the tail fin along the body of the shaft may be fixed along the shaft by a tail fin position locking mechanism. Games utilizing horseshoe projectile devices in accordance with embodiments of the invention are further discussed below.

Games Utilizing Horseshoe Projectile Devices

The horseshoe projectile devices may be used to play various games with one or more players. As described herein, horseshoe projective devices are aerodynamically configurable allowing them to adjust and providing users with a learning curve to master the skill of utilizing such devices. In addition, horseshoe projective devices may make games, which may be difficult to master and often dangerous for players when utilizing conventional horseshoes, easier and safer to play.

A game utilizing horseshoe projectile devices in accordance with certain embodiments of the invention is shown in FIG. 1. In many embodiments, a horseshoe projectile device 108 may be utilized in a game 100. For example, a version of the game 100 may include a station 110 having a base 112 and a post 114. In some embodiments, a first user may throw a first horseshoe projective device 108 at the station 110 attempting to hook a horseshoe of the first horseshoe projective device 108 onto the post 114. Further, a second user may throw a second horseshoe projective device 116 at the station 110 attempting to hook a horseshoe of the second horseshoe projective device 116 onto the post 114. Players may choose to keep score by awarding points when a horseshoe projectile device 108 hooks onto the post 114. Players may play to a set score or for a set amount of time depending on player preference. Alternatively, players may choose to award game points based on how close to the post 114 the horseshoe 104 of the horseshoe projectile device 108 lands. Players may choose to play solo, individually against other players, or in teams. The game 100 may be played by allotting four points when a player lands the horseshoe projectile device 108 around the post 114 of the station 110, three points when the player lands the horseshoe projectile device 108 leaning against the post 114 of the station 110, and two points when the player lands the horseshoe projectile device 108 touching the post 114 of the station 110. The first player(s) to twenty-one points win the game.

In reference to FIG. 1, the horseshoe projective devices may include various components that may be adjustable allowing for aerodynamic configurability of the horseshoe projective device. For example, the horseshoe projectile device 108 may include a shaft 102, a horseshoe 104, and a tail fin 106. In some embodiments, the length of the shaft 102 is extendable, as further described below, to allow for users to customize the length of the horseshoe projectile device 108. In many embodiments, a longer length may allow users with relatively larger hands (e.g., adults) to comfortably grip the shaft 102, while a shorter length may allow users with smaller hands (e.g., children) to comfortably grip the shaft 102. In various embodiments, a shorter length may also allow the user to more easily maneuver the horseshoe projectile device 108 and make it more aerodynamic, which may make the game 100 easier for some users. In addition, a longer length may make it more difficult to maneuver the horseshoe projectile device 108 and make it less aerodynamic, which may make the game 100 more challenging for more advanced users.

Although specific games utilizing horseshoe projective devices are discussed above with respect to FIG. 1, any of a variety of games utilizing various horseshoe projective devices as appropriate to the requirements of a specific application can be utilized in accordance with embodiments of the invention. Various horseshoe projective devices in accordance with embodiments of the invention are discussed further below.

Horseshoe Projectile Devices

As described above, horseshoe projective devices may include various components that may be adjustable allowing for aerodynamic configurability of the horseshoe projective devices.

Figure 2:
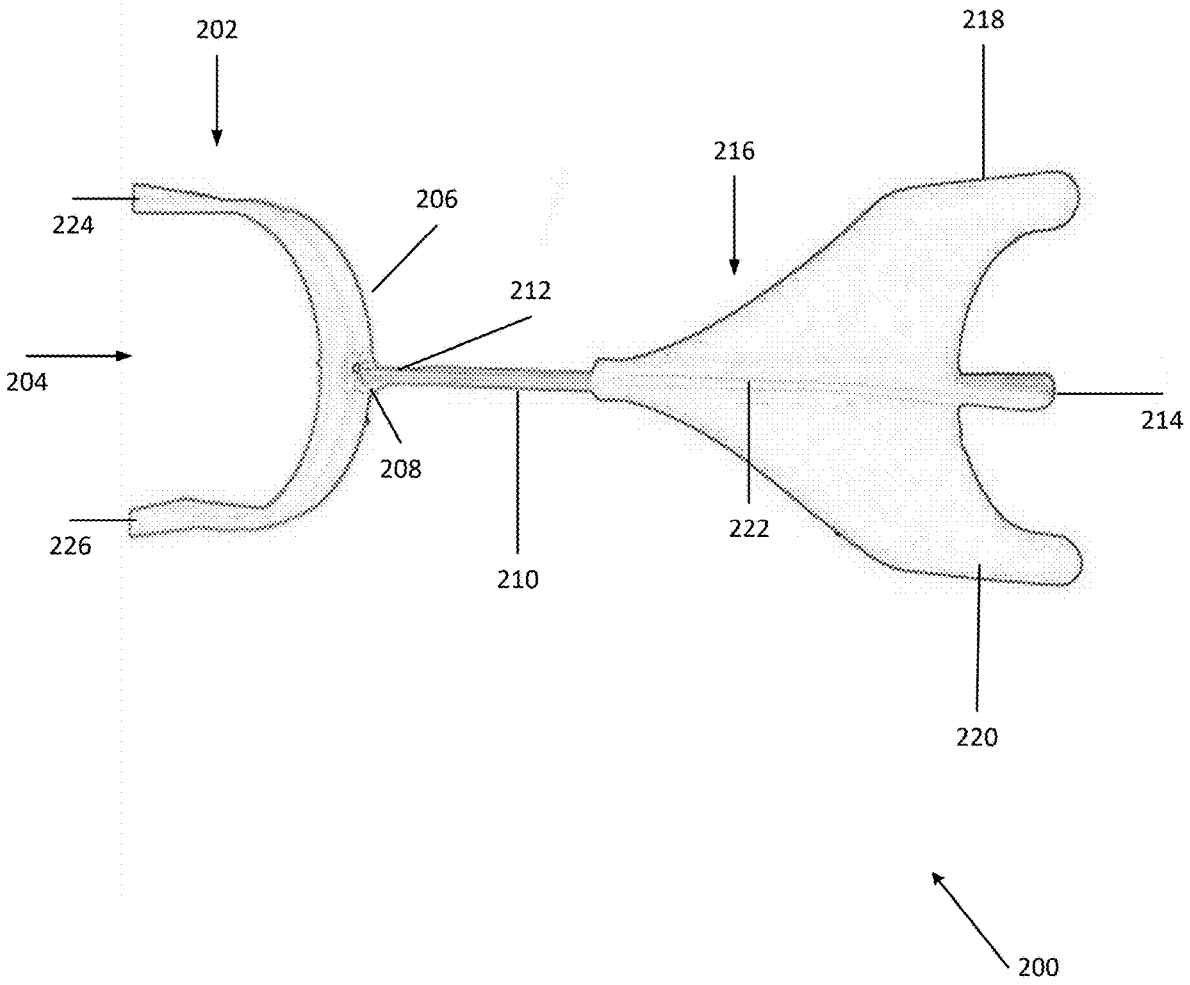
FIG. 2 illustrates a horseshoe projectile device in accordance with certain embodiments of the invention.

A horseshoe projectile device in accordance with certain embodiments of the invention is shown in FIG. 2. In many embodiments, a horseshoe projectile device 200 includes a horseshoe 202, a shaft 210, and a tail fin 216. The horseshoe 202 may include an open end 204 and a closed end 206. In many embodiments, the open end 204 may be utilized to hook the horseshoe projectile device 108 into a target (e.g., a post, etc.). In various embodiments, the closed end 206 may be used to stop the momentum of the horseshoe projectile device 200 when the horseshoe projectile device 200 hits the target such as, but not limited to, a post. In some embodiments, the horseshoe projectile device 200 may include a first horseshoe protective cover 224 and a second horseshoe protective cover 226 on the open end 204. The first horseshoe protective cover 224 and the second horseshoe protective cover 226 may be included to be an extra protection to minimize injury to players, especially younger children. The first horseshoe protective cover 224 and the second horseshoe protective cover 226 may be made of softer material such as Styrofoam or elastomers to avoid potential injuries. In several embodiments, the horseshoe 202 may also include a mounting point 208 that allows for the horseshoe 202 to connect to a shaft 210 at a first end of the shaft 212. In various embodiments, the horseshoe 202 may spin or lock relative to the shaft 210, as further described below. The mounting point 208 may be made utilizing various components, as further described below. The tail fin 216 may be connected to the shaft 210 of the horseshoe projectile device 200 at the second end of the shaft 214.

In reference to FIG. 2, the tail fin 216 may also include one or more wings (e.g., first wing 218, second wing 220, third wing 222), as further described below. In some embodiments, the tail fin 216 may also spin or lock relative to the shaft 210 and may slide or lock along the length of the shaft 210, as further described below.

Figure 6:
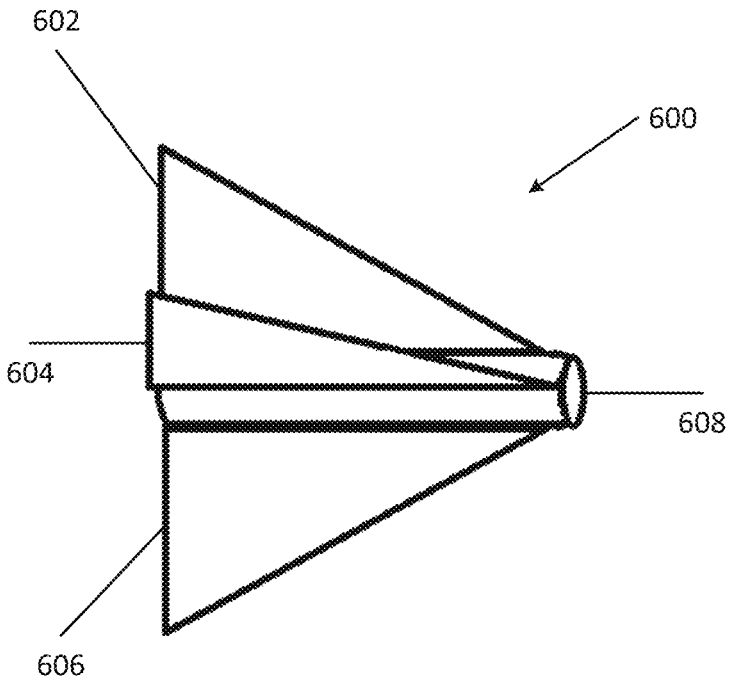
FIG. 6 illustrates a tail fin of a horseshoe projectile device in accordance with certain embodiments of the invention.

Tail fins can optimize the aerodynamics of flying objects by providing extra surface area, increasing time aloft. Flying objects with multiple fins have enhanced stability in flight, as air is channeled along each fin. In many embodiments, a tail fin of a horseshoe projective device may be constructed to stabilize the flight of the horseshoe projective device. For example, the tail fin may include one or more wings to assist in flight stabilization and may also act as a counterweight to the horseshoe. A tail fin of a horseshoe projectile device in accordance with certain embodiments of the invention is shown in FIG. 6. The tail fin 600 may include a first wing 602, a second wing 604, a third wing 606, and a bore 608. The bore 608 may be an opening along a center of the tail fin 600. In some embodiments, the bore 608 may allow for the tail fin 600 to slide onto a shaft of a horseshoe projective device. For example, the bore 608 may slide onto the second end 214 of the shaft 210 as illustrated in FIG. 2. The wings 602, 604, 606 of the tail fin 600 may give the horseshoe projectile device more stability when thrown by allowing air to flow between the wings 602, 604, 606. The tail fin 600 may also help the distribution of weight of the horseshoe projectile device by counter-balancing the weight of the horseshoe and ensuring the horseshoe projectile device does not fall down due to increased weight in the front of the device.

In reference to FIG. 2, the shaft 210 may be made using various materials including, but not limited to, plastic, Styrofoam, mixed metals, etc. In some embodiments, the horseshoe 202 may be made using various materials including, but not limited to, plastic, Styrofoam, mixed metals, elastomers, or any combination of Plastics, etc. and can be rigid or flexible, depending on the material used. The horseshoe 202 can also be hollow, solid, or partially hollow and solid. Further, the tail fin 216 may be made using various materials including, but not limited to, plastic, Styrofoam, mixed metals, elastomers, or any combination of Plastics, etc. The materials may be selected based on the recommended use of the game. For example, when considering the safety of children who may play the game, a softer material such as Styrofoam or elastomers may be the better option to avoid potential injuries. However, the softer materials would likely diminish the aerodynamics of the game and require the station to be placed closer to the players; this would align with the decision to make the game both safer and easier for children to play. When considering making the game more difficult, using harder materials, such as plastic or mixed metals, would allow for the horseshoe projectile device to be able to travel longer distances. As a result, the players could place the station further from the players, which would increase the difficulty of the game.

Although specific horseshoe projectile devices are discussed above with respect to FIG. 2, any of a variety of horseshoe projectile devices including a variety shafts, horseshoes, and tail fins as appropriate to the requirements of a specific application can be utilized in accordance with embodiments of the invention. Configurable fin connections of horseshoe projectile devices in accordance with embodiments of the invention are discussed further below.

Configurable Fin Connections of Horseshoe Projectile Devices

In many embodiments, the aerodynamics of horseshoe projectile devices may be configured by adjusting the position of the tail fin along the shaft. For example, when the tail fin is forward along the shaft relative to the horseshoe, the mass of the horseshoe projectile device may be more concentrated towards a center point of the horseshoe projective device, resulting in a shorter period aloft when thrown. The device may also be more easily grasped by children or others with smaller hands when the tail fin is forward along the shaft. When the tail fin is retracted along the shaft relative to the horseshoe, the mass of the horseshoe projectile device may be more distributed, resulting in a longer period aloft when thrown. This configuration may also be more comfortable for users with larger hands. Further, in some embodiments, the tail fin may slide freely along the length of shaft during flight, and thus the aerodynamics of the device may spontaneously adjust during flight.

Figure 4A:
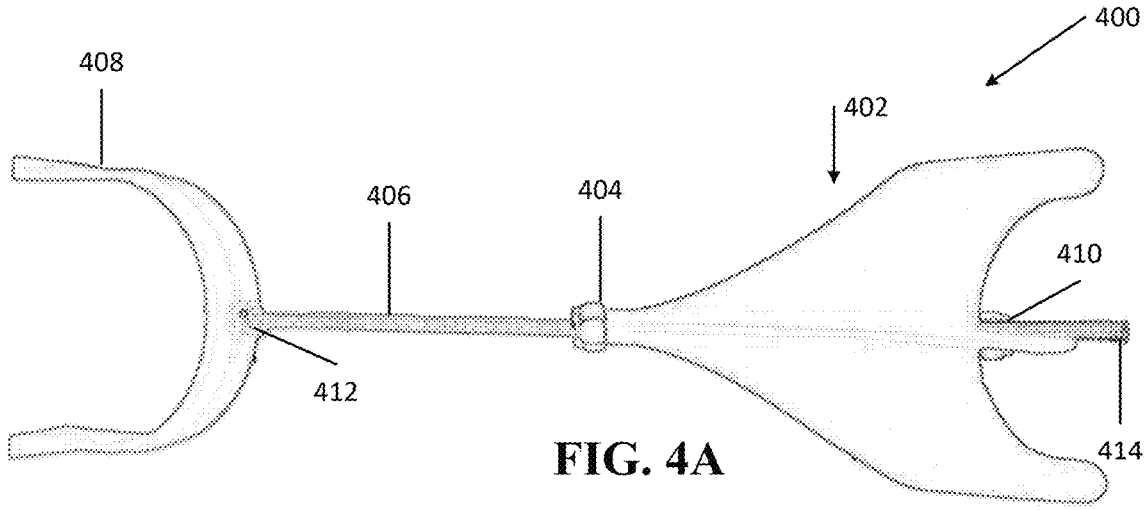
FIG. 4A illustrates a horseshoe projectile device with a tail fin in a retracted position in accordance with certain embodiments of the invention.

The aerodynamics of the horseshoe projectile device may be configured by placing the tail fin in a retracted position along the shaft. In many embodiments, a tail fin in a retracted position may allow the horseshoe projectile device to fly further without losing stability of the flight path. A horseshoe projectile device with a tail fin in a retracted position in accordance with certain embodiments of the invention is illustrated in FIG. 4A. The side-on view 400 illustrates a first tail fin lock 404 and second tail fin lock 410 securing tail fin 402 in a retracted position along shaft 406 relative to horseshoe 408. When in a retracted position, tail fin 402 is closer to second end of shaft 414 than to first end of shaft 412 and horseshoe 408. In some embodiments, first tail fin lock 404 and second tail fin lock 410 may have various positions along shaft 406. In some embodiments, the various positions of the first and second tail fin locks 404, 410 may be controlled by threading along shaft 406 and complementary threading inside first tail fin lock 404 and second tail fin lock 410. In some embodiments, first tail fin lock 404 and second tail fin lock 410 may have adjustable diameters that when constricted secure first tail fin lock 404 and second tail fin lock 410 against shaft 406 by friction. One of ordinary skill will recognize various ways to adjustably fix the positions of first tail fin lock 404 and second tail fin lock 410 along shaft 406.

Figure 4B:
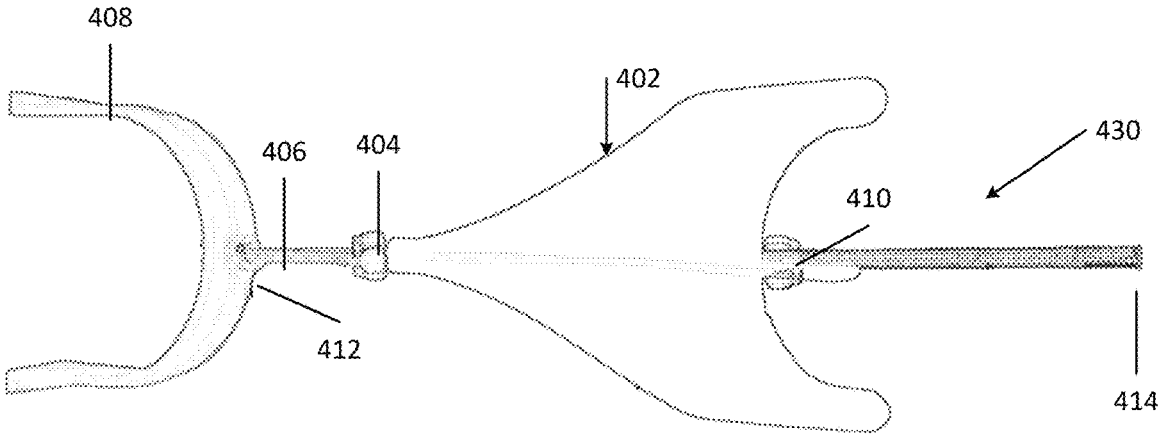
FIG. 4B illustrates a horseshoe projectile device with a tail fin in a forward position in accordance with certain embodiments of the invention.

Further, the aerodynamics of the horseshoe projectile device may be configured by placing the tail fin in a forward position along the shaft. In many embodiments, a tail fin in a forward position may allow users with smaller hands to more easily grip the horseshoe projectile device. A tail fin in a forward position may also allow a diminished time aloft, providing users with better aim in high wind conditions. A horseshoe projectile device with a tail fin in a forward position in accordance with certain embodiments of the invention is illustrated in FIG. 4B. The side-on view 430 illustrates first tail fin lock 404 and second tail fin lock 410 securing tail fin 402 in a forward position along shaft 406 relative to horseshoe 408. When in a forward position, tail fin 402 is closer to first end of shaft 412 and horseshoe 408 than to second end of shaft 414.

Figure 4C:
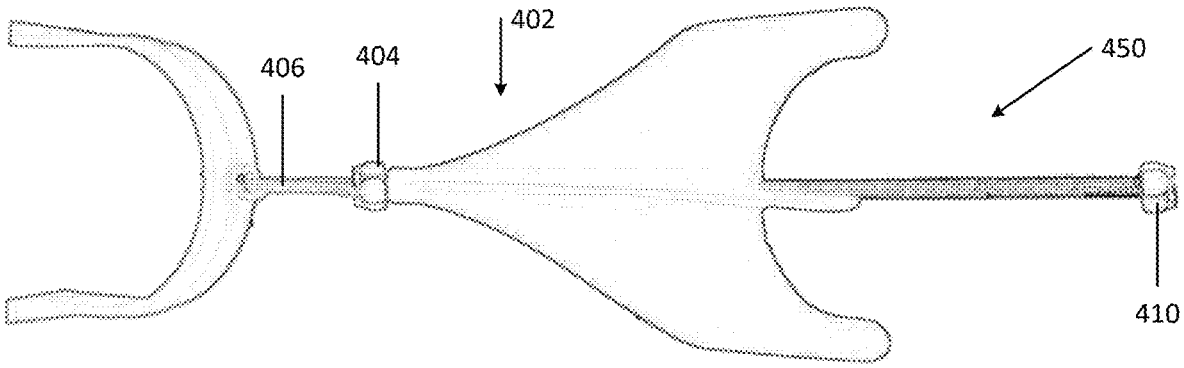
FIG. 4C illustrates a horseshoe projectile device with a tail fin freely moveable in accordance with certain embodiments of the invention.
Figure 5:
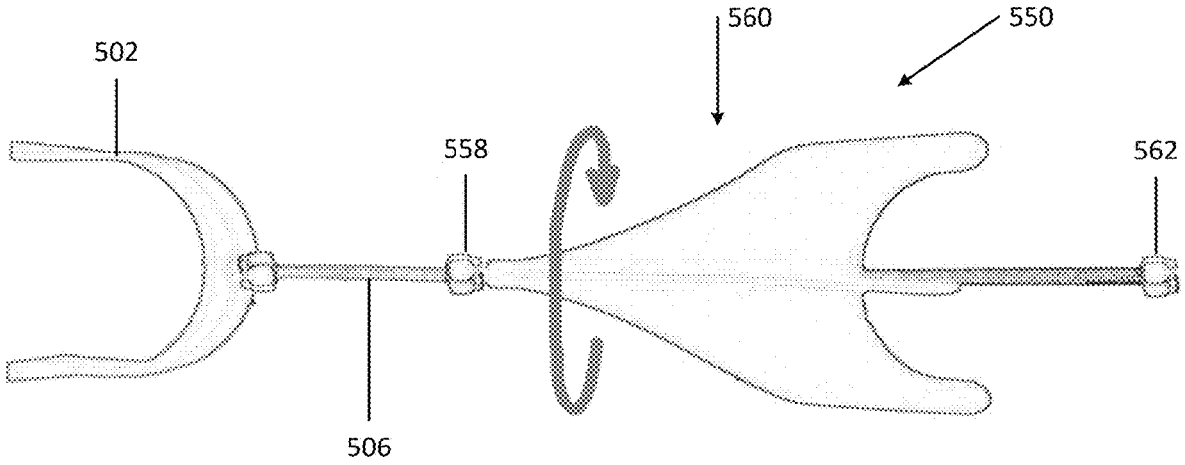
FIG. 5 illustrates a horseshoe projectile device showing rotation of a tail fin in accordance with certain embodiments of the invention.

In addition, the aerodynamics of the horseshoe projectile device may also be configured by allowing the tail fin to freely slide along the length of the shaft. A tail fin that freely slides along the length of the shaft may allow the horseshoe projectile device's aerodynamics to change during flight. A tail fin that freely slides along the length of the shaft may also allow the horseshoe projectile device's travel through the air to be rapid at first, then slowed at the end, as the tail fin may move from a forward position to a retracted position during flight. A horseshoe projectile device with a tail fin that may freely slide along the shaft in accordance with certain embodiments of the invention is illustrated in FIG. 4C. The side-on view 450 illustrates first tail fin lock 404 and second tail fin lock 410 providing a space along shaft 406 in which tail fin 402 can slide freely between a forward position, as described above, and a retracted position, also as described above In many embodiments, the tail fin can rotate relative to the shaft to further adjust aerodynamics during flight. A horseshoe projectile device with a freely rotating tail fin in accordance with certain embodiments of the invention is illustrated in FIG. 5. The side-on view 550 illustrates first tail fin lock 558 and second tail fin lock 562 configured such that tail fin 560 can rotate relative to shaft 506. In some embodiments, when tail fin 560 rotates around shaft 506, tail fin 560 may also slide freely along shaft 506 between a forward position, as described above, and a retracted position, as also described above. In other embodiments, when tail fin 560 rotates around shaft 506, tail fin 560 does not slide along shaft 556. In some embodiments, the manner of adjusting first tail fin lock 558 and second tail fin lock 562 will determine whether tail fin 560 slides freely along shaft 556 when the horseshoe projectile device is configured to allow tail fin 560 to rotate around shaft 506. In some embodiments, first tail fin lock 558 and second tail fin lock 562 have positions along shaft 506 that are controlled by threading along shaft 506 and complementary threading inside first tail fin lock 558 and second tail fin lock 562. In some embodiments, first tail fin lock 558 and second tail fin lock 562 have adjustable diameters that when constricted secure first tail fin lock 558 and second tail fin lock 562 against shaft 506 by friction. In some embodiments, the positions of first tail fin lock 558 and second tail fin lock 562 relative to tail fin 560 will control the ability of tail fin 560 to rotate.

Although specific horseshoe projectile devices with configurable tail fin connections are discussed above with respect to FIGS. 4A-5, any of a variety of horseshoe projectile devices including a variety shafts, horseshoes, and tail fins as appropriate to the requirements of a specific application can be utilized in accordance with embodiments of the invention. Horseshoe projectile devices with configurable horseshoes in accordance with embodiments of the invention are discussed further below.

Horseshoe Projectile Devices with Configurable Horseshoes

In many embodiments, the aerodynamics of the horseshoe projectile device may be configured by controlling whether or not the horseshoe may rotate relative to the shaft during flight. When the horseshoe is allowed to rotate relative to the shaft during flight, the aerodynamics of the horseshoe projectile device may adjust during flight, resulting in longer or shorter periods aloft. Further, when the horseshoe is allowed to rotate relative to the shaft during flight, the horseshoe may rotate such that it arrives with its open end perpendicular to or at any angle from the target, resulting in a more challenging game. Finally, when the horseshoe is allowed to rotate relative to the shaft during flight, the horseshoe projectile device may be more responsive to high wind conditions. When the horseshoe is not allowed to rotate relative to the shaft during flight, players may find the path of the horseshoe in air to be more predictable, resulting in a less challenging game.

Figure 10:
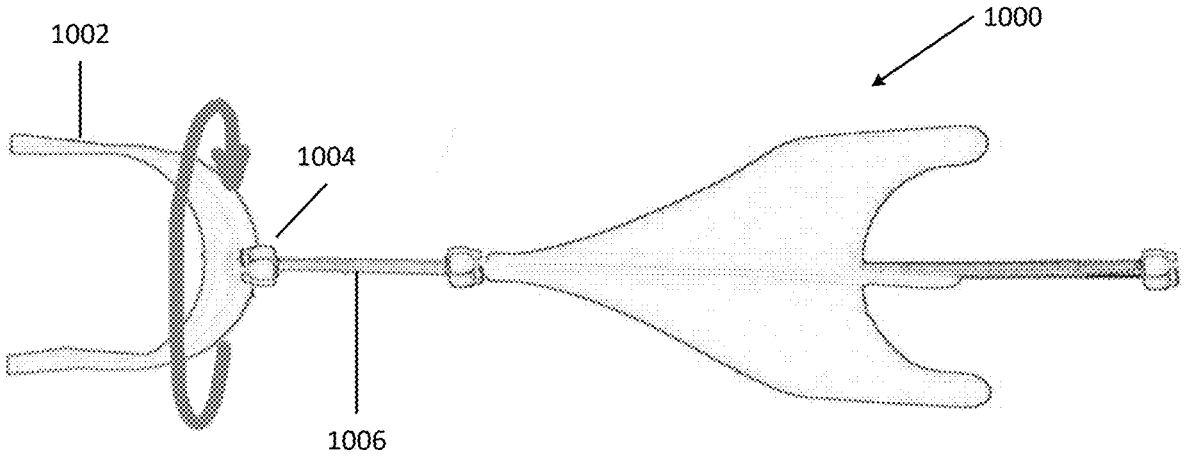
FIG. 10 illustrates a horseshoe projectile device showing rotation of a horseshoe in accordance with certain embodiments of the invention.

In many embodiments, the aerodynamics of the horseshoe projectile device may be configured such that the horseshoe may rotate relative to the shaft. A horseshoe projectile device showing rotation of a horseshoe in accordance with certain embodiments of the invention is illustrated in FIG. 10. The side-on view 1000 illustrates horseshoe 1002 connected to shaft 1006 via lockable horseshoe connection 1004. In some embodiments, lockable horseshoe connection 1004 may allow horseshoe 1002 to rotate relative to shaft 1006. In some embodiments, lockable horseshoe connection 1004 will prevent horseshoe 1002 from rotating relative to shaft 1006. In some embodiments, lockable horseshoe connection 1004 will be configurable to allow the user to control whether horseshoe 1002 rotates relative to shaft 1006. In some embodiments, lockable horseshoe connection 1004 will be controlled by threading along shaft 1006 and complementary threading inside lockable horseshoe connection 1004. In some embodiments, lockable horseshoe connection 1004 will be controlled by a latch or other device that affixes the position of horseshoe 1002 relative to shaft 1006.

Figure 9:
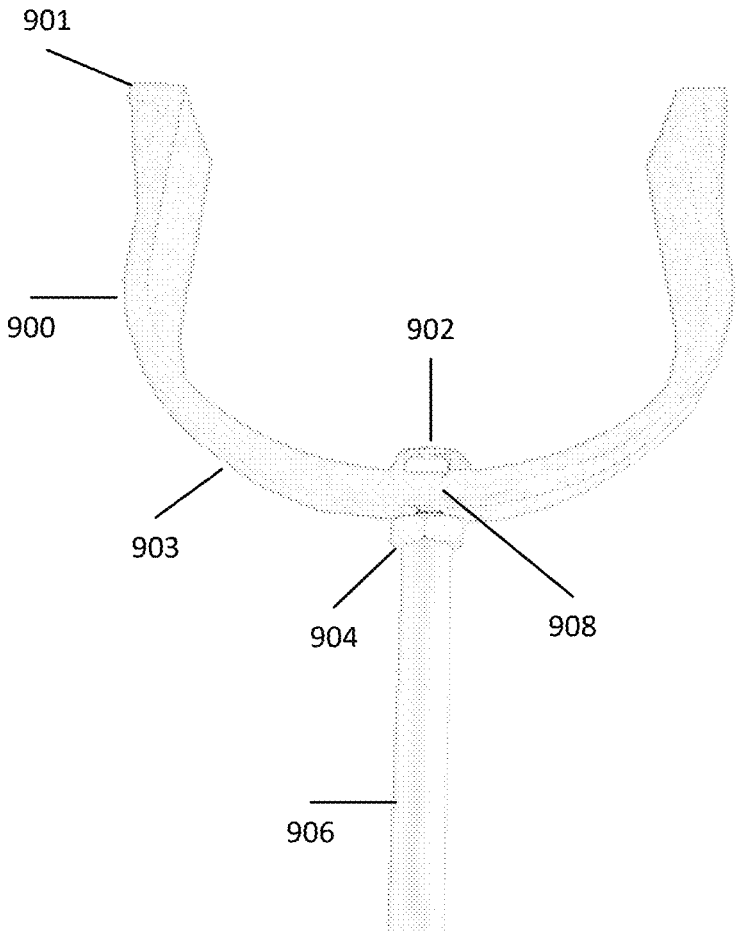
FIG. 9 illustrates a horseshoe and shaft connected by a lockable horseshoe connection in accordance with certain embodiments of the invention.

In many embodiments, the horseshoe may by connected to the shaft by a lockable horseshoe connection. A horseshoe and shaft connected by a lockable horseshoe connection in accordance with certain embodiments of the invention is illustrated in FIG. 9. Horseshoe 900 may connect to a shaft 906 at a mounting point 908, at closed end 903 of the horseshoe 900. In many embodiments, the lockable horseshoe connection may include a first horseshoe lock 902 and a second horseshoe lock 904. In some embodiments, the first horseshoe lock 902 and the second horseshoe lock 904 may be threaded to receive by shaft 906, which may have complimentary threading. In some embodiments, the first horseshoe lock 902 and the second horseshoe lock 904 may be loosened along the shaft 906 such that the horseshoe 900 is free to rotate relative to shaft 906. In some embodiments, the first horseshoe lock 902 and the second horseshoe lock 904 may be tightened along shaft 906 such that friction prevents the horseshoe 900 from rotating relative to the shaft 906.

Although specific horseshoe projectile devices with configurable horseshoe rotations are discussed above with respect to FIGS. 10 and 9, any of a variety of horseshoe projectile devices with configurable horseshoes as appropriate to the requirements of a specific application can be utilized in accordance with embodiments of the invention. Horseshoe projectile devices with extendable shafts in accordance with embodiments of the invention are discussed further below.

Extendable Shafts of Horseshoe Projectile Devices

Horseshoe projectile devices may include shafts that are extendable in length. The length of the shaft may make the game easier or more difficult by affecting the aerodynamics of the horseshoe projectile device. A horseshoe projectile device with a shaft in a shortened configuration in accordance with certain embodiments of the invention is shown in FIG. 3A. The horseshoe projectile device with shortened extendable shaft 300 may include a shaft 302 that is in the shortened configuration, a tail fin 304, and a horseshoe 306. Shaft 302 may be extendable by including a first slidable rod 308, a second slidable rod 310, and a slidable rod lock 312. The first slidable rod 308 may be hollow inside and have a wider circumference such that the second slidable rod 310 can fit inside the first slidable rod 308. The length of the shaft 302 may be adjusted by adjusting how much of the length of the second slidable rod 310 is inserted into the first slidable rod 308. A shorter shaft 302 length makes the horseshoe projectile device easier to aim because the aerodynamics is increased because of the decreased air resistance. A shorter configuration may be more desirable for players who intend to make the game easier to play. The shorter configuration may also make the horseshoe projectile device easier to hold for players with smaller hands, especially smaller children. The positions of the first slidable rod 308 and the second slidable rod 310 may be locked into place with the slidable rod lock 312. The slidable rod lock 312 may be made of various material including, but not limited to, a rubber washer, which prevents the second slidable rod 310 from sliding out of the first slidable rod 308 when the horseshoe projectile device is thrown by creating tension clamping. The slidable rod lock 312 may also be the joining point of the first slidable rod 308 and the second slidable rod 310, where the second slidable rod 310 has threading along the outer surface of the rod and the first slidable rod 308 has counter-threading on the inner surface of the hollow of the rod. The counter-threading of the first slidable rod 308 can be threaded into the threading of the second slidable rod 310 to shorten or lengthen the length of the shaft 302.

A horseshoe projectile device with a shaft in a lengthened configuration in accordance with certain embodiments of the invention is shown in FIG. 3B. A horseshoe projectile device with lengthened extendable shaft 350 may include a shaft 302 that is in the lengthened configuration, a tail fin 304, and a horseshoe 306. As described above, the shaft 302 may include a first slidable rod 308, a second slidable rod 310, and a slidable rod lock 312. The length of the shaft 302 may be adjusted by adjusting how much of the length of the second slidable rod 310 is inserted into the first slidable rod 308, as further described above. The longer length of the shaft 302 is more difficult to throw the horseshoe projectile device 350 because the aerodynamics are reduced through increased air resistance. The longer shaft 302 length may be desired when a player intends to make the game more difficult to play.

Figure 7:
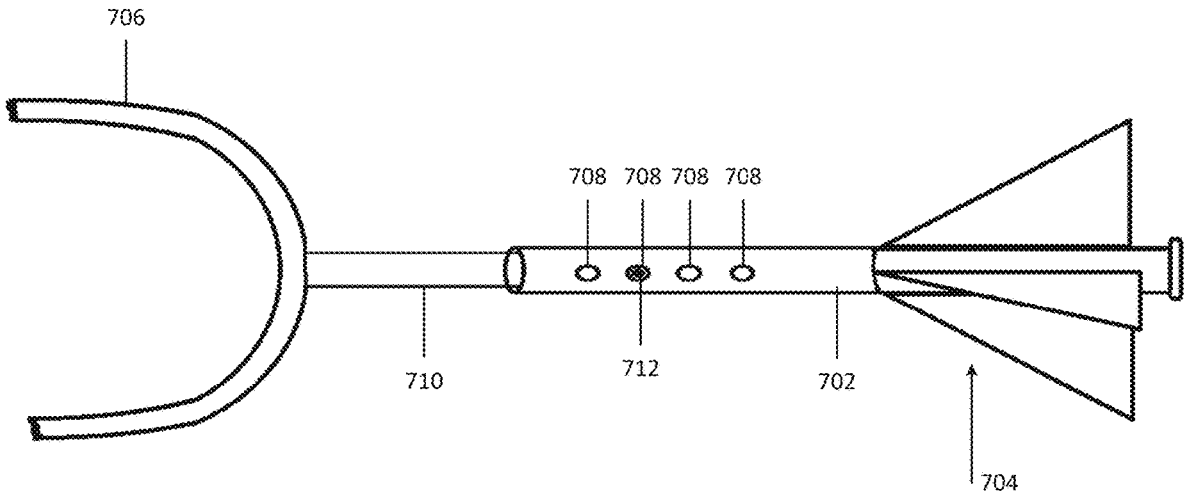
FIG. 7 illustrates a slidable rod lock of a horseshoe projectile device in accordance with certain embodiments of the invention.

In some embodiments, the slidable rod lock may comprise a depressible raised button on the second slidable rod having a depressed position and an extended position and corresponding plurality of holes on the first slidable rod, such that when the second slidable rod is nested within the first slidable rod, the depressible raised button will be extended through one of the plurality of holes on the first slidable rod and secure the relative positions of the first slidable rod and second slidable rod. This may make it easy for users to adjust the relative positions of the first slidable rod and second slidable rod, thereby adjusting the length of the shaft by depressing the depressible button, sliding the rods relative to each other, and allowing the depressible button to extend into a different hole among the plurality of holes on the first slidable rod. A horseshoe projectile device comprising a slidable rod lock comprising a depressible raised button in accordance with an embodiment of the invention is illustrated in FIG. 7. Horseshoe 706 may connect to a second slidable rod 710, which may be nested within a first slidable rod 702. In some embodiments, a tail fin 704 may receive the first slidable rod 702. When in a locked position, depressible button 712 may extend through one of the plurality of holes 708 in first slidable rod 702 such that depressible button 712 is convex relative to the surface of second slidable rod 710 and has a height greater than the thickness of the first slidable rod 702, thereby securing the relative positions of first slidable rod 702 and second slidable rod 710.

Figure 8A:
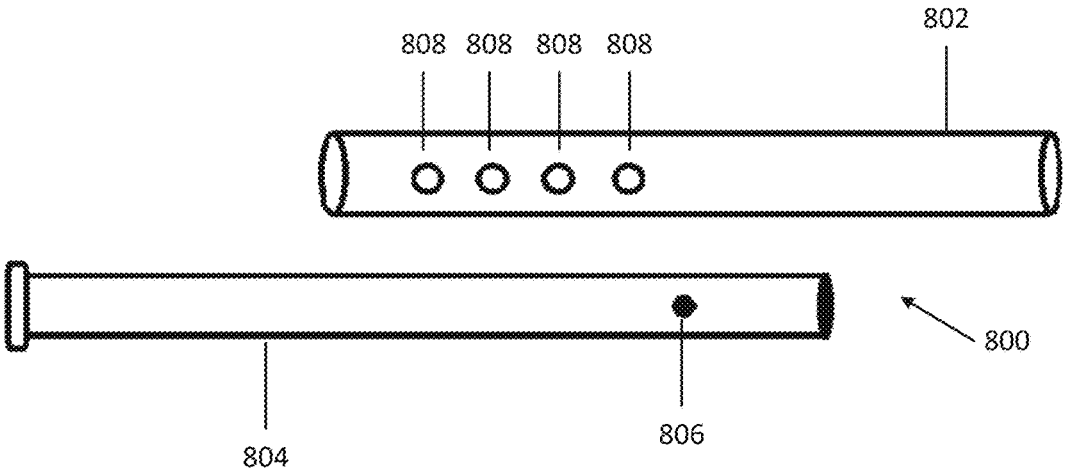
FIG. 8A illustrates a disassembled slidable rod lock in accordance with certain embodiments of the invention.

An exploded view of a shaft comprising a slidable rod lock comprising a depressible button wherein the second slidable rod is un-nested from the first slidable rod is illustrated in FIG. 8A. The shaft may include a second slidable rod 804 that may include a depressible button 806. Further, the shaft may include a first slidable rod 802 that may include a plurality of holes 808. To nest a second slidable rod 804 within the first slidable rod 802, a user may depress the depressible button 806 and slide second slidable rod 804 into first slidable rod 802.

Figure 8B:
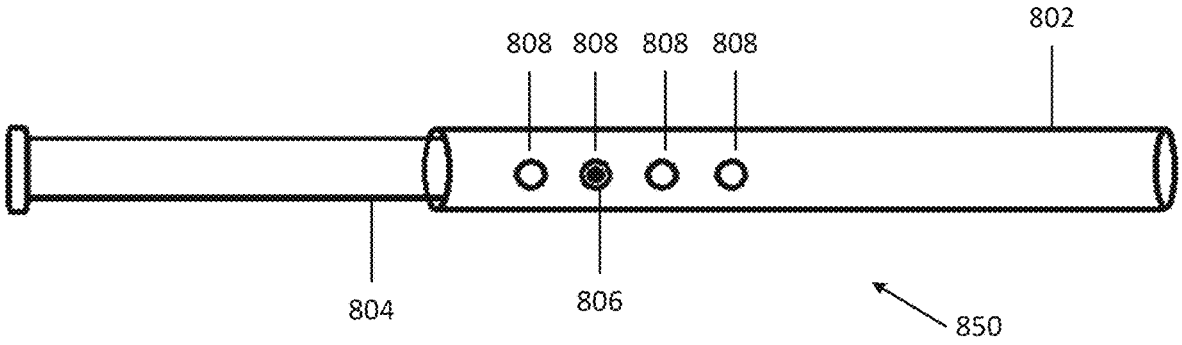
FIG. 8B illustrates an assembled slidable rod lock in accordance with certain embodiments of the invention.

A detailed view of a shaft with a second slidable rod is nested in a first slidable rod and a depressible button in the locked position in accordance with an embodiment of the invention is illustrated in FIG. 8B. The shaft may include a second slidable rod 804 that may include a depressible button 806, wherein the locked position is convex relative to the outer surface of the second slidable rod 804, and wherein when in the locked position depressible button 806 has a height greater than the thickness of a first slidable rod 802. Depressible button 806 may be in the locked position and therefore extends through one of the plurality of holes 808 on first slidable rod 802 to a height greater than the outer surface of first slidable rod 802. This locked position of depressible button 806 secures the relative positions of first slidable rod 802 and second slidable rod 804.

Although specific horseshoe projectile devices with extendable shafts are discussed above with respect to FIGS. 3 and 7-8B, any of a variety of horseshoe projectile devices including a variety extendable shafts as appropriate to the requirements of a specific application can be utilized in accordance with embodiments of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A horseshoe projectile device having configurable aerodynamics, the horseshoe projectile device comprising:

a horseshoe comprising an open end and a closed end, wherein the closed end comprises a mounting point for receiving a shaft;

the shaft comprising a first end, a second end, and a body, wherein the first end of the shaft connects to the mounting point of the horseshoe; and a tail fin comprising a bore that receives the body of the shaft and having a plurality of wings extending outward from the bore.

2. The horseshoe projectile device of claim 1, wherein the horseshoe and the shaft are attached at the mounting point of the horseshoe such that the horseshoe can rotate relative to the shaft.

3. The horseshoe projectile device of claim 1, wherein the horseshoe and the shaft are attached at the mounting point of the horseshoe such that the horseshoe cannot rotate relative to the shaft.

4. The horseshoe projectile device of claim 1, wherein the horseshoe and the shaft are attached at the mounting point of the horseshoe by a lockable horseshoe connection having a first configuration that prevents the horseshoe from rotating relative to the shaft and a second configuration that allows the horseshoe to rotate relative to the shaft.

5. The horseshoe projectile device of claim 4, wherein the lockable horseshoe connection comprises a first horseshoe lock and a second horseshoe lock.

6. The horseshoe projectile device of claim 1, wherein the shaft is extendable.

7. The horseshoe projectile device of claim 6, wherein the shaft comprises:

a first slidable rod having an inner surface, an outer surface, and a thickness, wherein the first slidable rod is hollow; and wherein the thickness is the distance between the inner surface and the outer surface;

a second slidable rod having an outer surface, wherein the second slidable rod is nested within the first slidable rod.

8. The horseshoe projectile device of claim 7, wherein the shaft further comprises a slidable rod lock, and wherein the slidable rod lock fixes a depth to which the second slidable rod is nested within the first slidable rod, and wherein the depth to which the second slidable rod is nested within the first slidable rod controls the length of the shaft.

9. The horseshoe projectile device of claim 8, wherein the slidable rod lock comprises:

a depressible raised button on the second slidable rod having a locked position and an unlocked position wherein the locked position is convex relative to the outer surface of the second slidable rod, and wherein the locked position has a height greater than the thickness of the first slidable rod;

a plurality of holes on the first slidable rod wherein each hole of the plurality of holes is configured to receive the depressible raised button on the second slidable rod such that the depressible raised button locks the relative positions of the first slidable rod and second slidable rod.

10. The horseshoe projectile device of claim 1, wherein the bore of the tail fin receives the body of the shaft such that the tail fin can rotate relative to the shaft.

11. The horseshoe projectile device of claim 1, wherein the bore of the tail fin receives the body of the shaft such that the tail fin cannot rotate relative to the shaft.

12. The horseshoe projectile device of claim 1, wherein the horseshoe projectile device comprises a tail fin fixture having a first configuration that prevents the tail fin from rotating relative to the shaft and a second configuration that allows the tail fin to rotate relative to the shaft.

13. The horseshoe projectile device of claim 10, wherein the position of the tail fin along the body of the shaft is fixed.

14. The horseshoe projectile device of claim 10, wherein the position of the tail fin along the body of the shaft is movable.

15. The horseshoe projectile device of claim 10, wherein the position of the tail fin along the body of the shaft is adjustable and wherein a tail fin fixture fixes the position of the tail fin along the body of the shaft at a desired position.

16. The horseshoe projectile device of claim 15, wherein the tail fin fixture comprises a first tail fin lock and a second tail fin lock.

17. The horseshoe projectile device of claim 11, wherein the position of the tail fin along the body of the shaft is fixed.

18. The horseshoe projectile device of claim 11, wherein the position of the tail fin along the body of the shaft is movable.

19. The horseshoe projectile device of claim 11, wherein the position of the tail fin along the body of the shaft is adjustable and wherein a tail fin fixture fixes the position of the tail fin along the body of the shaft at a desired position.

20. The horseshoe projectile device of claim 19, wherein the tail fin fixture comprises a first tail fin lock and a second tail fin lock.

* * * * *